United States Patent [19]

Grimmer et al.

[11] 4,283,926

[45] Aug. 18, 1981

[54] CONTROL DEVICE FOR FLAT KNITTING MACHINES HAVING CIRCULATING KNIT CARRIAGES

[75] Inventors: Eberhard Grimmer; Günther Kessler; Hartwig Müller, all of Karl-Marx-Stadt, German Democratic Rep.

[73] Assignee: Veb Kombinat Textima, Karl-Marx-Stadt, German Democratic Rep.

[21] Appl. No.: 120,855

[22] Filed: Feb. 11, 1980

[30] Foreign Application Priority Data

Feb. 13, 1979 [DD] German Democratic Rep. ... 211002

[51] Int. Cl.[3] ..... D04B 7/00; D04B 15/66

[52] U.S. Cl. ..... 66/75.2; 66/64

[58] Field of Search ..... 66/64, 75.1, 78, 125

[56] References Cited

U.S. PATENT DOCUMENTS

| | | | |
|---|---|---|---|
| 2,821,073 | 1/1958 | Mehnert | 66/75.1 |
| 3,962,890 | 6/1976 | Krause | 66/125 R |

FOREIGN PATENT DOCUMENTS

| | | | |
|---|---|---|---|
| 1015176 | 8/1952 | Fed. Rep. of Germany | 66/64 |

*Primary Examiner*—Ronald Feldbaum

*Attorney, Agent, or Firm*—Michael J. Striker

[57] ABSTRACT

The flat knitting machine having two pairs of consecutively arranged needle beds and a plurality of knit carriages circulating in one direction above the needle beds and each supporting adjustable control bars cooperating with stationary control plates arranged between the pairs of needle beds, includes a control device for controlling the position of the control bars by means of a plurality of parallel tracks formed in respective control plates to guide the assigned control bar in a plurality of control positions. The ends of respective tracks are arranged in different consecutively arranged sections and each section movably supports a pair of switching flaps or guides activated by separate control members. The control guides in each section are activated simultaneously and independently from one another so that when the advancing control bars leaves one section the latter is ready for readjustment according to the desired position of the control bar in the subsequent carriage.

14 Claims, 5 Drawing Figures

CONTROL DEVICE FOR FLAT KNITTING MACHINES HAVING CIRCULATING KNIT CARRIAGES

BACKGROUND OF THE INVENTION

This invention relates to a control device for flat knitting machines of the type having at least two pairs of consecutively arranged needle beds and a plurality of knit carriages circulating in one direction above the needle beds and each including control rods cooperating with control elements fixedly arranged outside the pairs of beds to displace the knit carriages according to the desired functions of the machine and according to the knitted design.

From the German Pat. No. 1 015 176, a flat bed knitting machine is known having two consecutively arranged pairs of needle beds and a plurality of knit carriages circulating in one direction above the needle beds to control automatically the operation of the knitting machine and the design of the knitted product such as for example the position of cams and the exchange of the yarn. For this purpose, the knit carriage is provided with a set of superimposed control rods adjustable into several switching positions. These switching rods are actuated by means of stationary switching plates arranged between perspective needle bed pairs and each being provided with fixed guided means for the control rods. The switching plates are adjustable by means of a multi-track chain driven by a sprocket wheel. This arrangement necessitates that the sprocket wheel performs a switching movement for each of the knit carriages whereby before each adjustment the switching plates are released and after each adjustment the plates are locked. This solution employing displacable switching plates has the disadvantage that the switching plates cannot be re-adjusted before the knit carriage with its control bars has passed through. In addition, the fact that the movable switching plates have relatively large mass brings about disadvantageous effects. The movable control plates require large installation space in the machine. The adjustment and locking of each knit carriage in several positions requires considerable mechanical work and also requires considerable time. Consequently, there is set a limit to the increase of knitting speed as well as to the increase of the number of knit carriages because the time required for displacing the switching plates and for guiding the control valves would be too long.

SUMMARY OF THE INVENTION

It is therefore a general object of the present invention to overcome the aforementioned disadvantages.

More particularly, it is an object of the invention to provide an improved control device for the knitting machines of the aforedescribed type which enables an increase of the knitting speed.

Another object of this invention is to provide such a control device which enables the increase of the number of knit carriages.

A further object of the invention is to provide a control device which requires only a small displacement of its movable parts and which requires small installation room.

An additional object of the invention is to provide such an improved control device which has a substantially reduced mass of its moving component parts.

In keeping with these objects and others which will become apparent hereafter, one feature of the invention resides, in a flat knitting machine of the abovedescribed type, in the provision of stationary switching plates each having a plurality of parallel tracks corresponding in number to the required switching positions for the control rods; the guiding of each control rod or bolt into the pre-selected guiding track is effected by means of switching flaps pivotably arranged on respective switching plates for closing the non-applicable guiding tracks; the switching flaps are arranged on two or more sections of the switching plates consecutively arranged in the direction of movement of the knit carriage to provide for a preliminary and a final selection of the desired guiding track. In each section, the flaps are arranged preferably in pairs actuated simultaneously whereas the flap pairs in respective sections are activated consecutively, that means in accordance with the movement of the switching bolt. The switching flaps have the form of elongated tongues pivotably or displacably supported on the plates to cross when activated the non-applicable tracks and to guide the control bars into the selected track.

According to another feature of this invention, the pairs of flaps in the downstream section of the control plate are pivotable about a common pivot point and extend across the width of one track only.

The individual switching flaps are activated by a single control member, by a pair of control members or by a combination of a control member with a biasing spring. This control member can be for example, a solenoid, a stepping motor, or a pneumatic or hydraulic control element. To reinforce the control flaps, there are provided reinforcing guiding attachments in the range of engagement of the flap with the control bolt.

In still another embodiment of this invention, each switching flap is in its rest position arrestable against the force of the biasing spring by means of a linkage coupled to the control member. Furthermore, the switching flaps in the range of their bearing are connected via a coupling actuated by the control bolt to a control element which protects the flap against displacement due to the action of the control bolt itself and thus against the force of the knit carriage.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
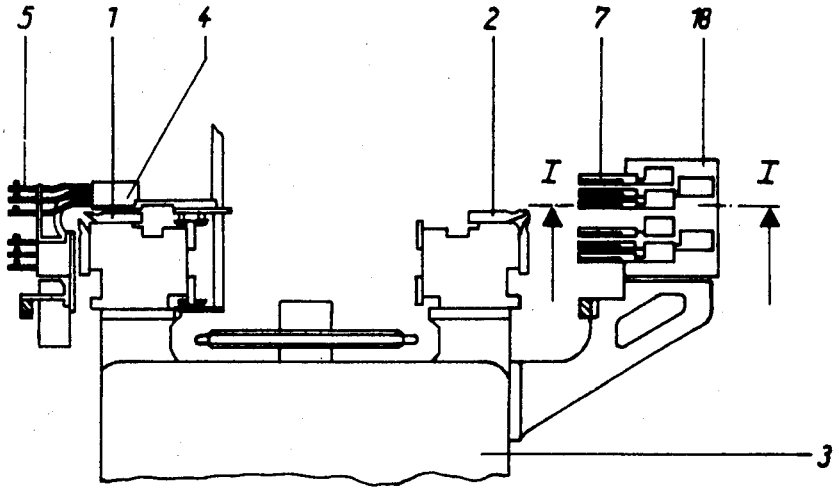
FIG. 1 is a sectional side view of a flat knitting machine having consecutively arranged pairs of needle beds.
Figure 2:
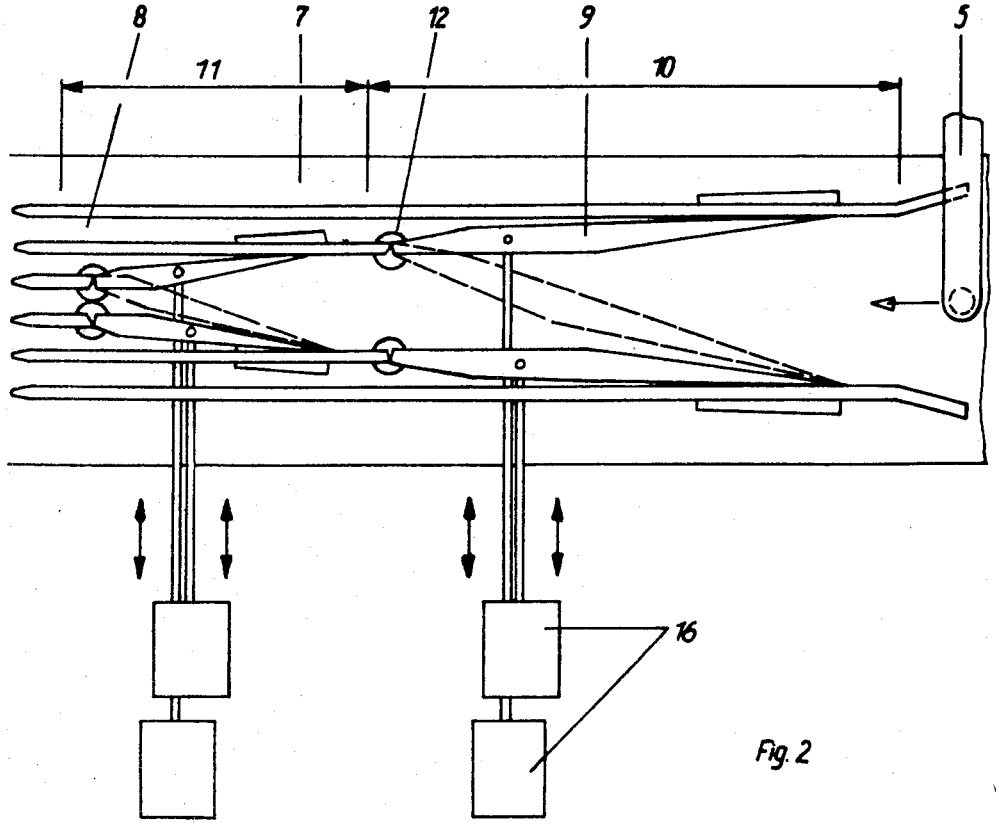
FIG. 2 is a top view of a control plate of the machine of FIG. 1 taken along the line I—I.
Figure 3:
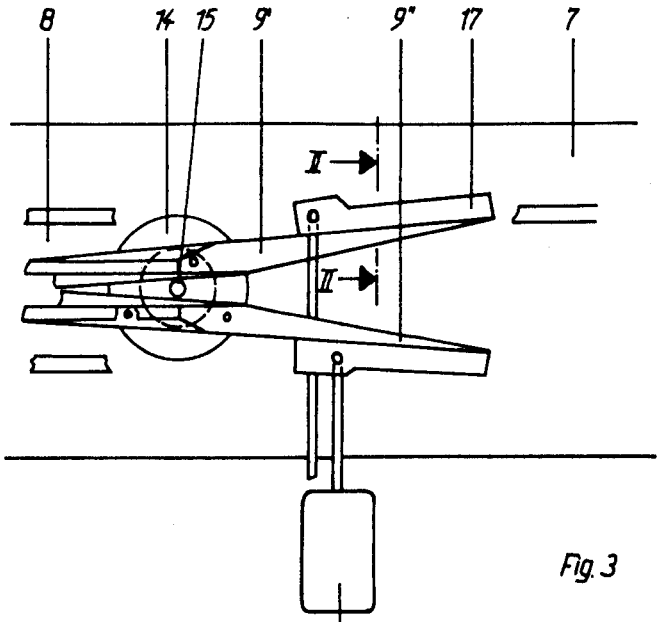
FIG. 3 is a modification of the plate of FIG. 2 including a common bearing for both inner flaps.
Figure 4:
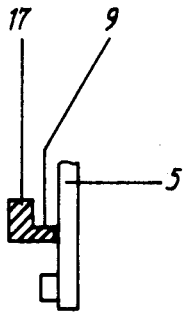
FIG. 4 is a section view of a part of FIG. 3 taken along the line II—II.

Referring to FIG. 1 there is schematically illustrated a section of a flat knitting machine having two consecutively arranged pairs of needle beds 1 and 2 supported on a machine frame 3. A plurality of a knit carriages 4 of which only one is illustrated in a front view circulate above the two pairs of needle beds 1 and 2. Each of the knit carriages 4 supports a plurality of superposed control or bolts 5 which are axially displacable in several switching positions for controlling all automatic functions of the machine and the design of the knitted produce such as for example the position of cams, the exchange of the yarn, the knitting speed and the like. The position of the control bolt 5 is adjusted by means of switching plates 7 arranged in the path of circulation of the bolts 5 between two pairs of needle beds 1 and 2 either immediately upstream or downstream of one of the two bed pairs or in the curved path of movement of the carriage. Each of the switching plates 7 is provided with fixed guiding tracks 8 and with movable switching flaps 9. As seen from FIG. 2, the switching flaps 9 are arranged in consecutive pairs in the direction of movement of control bars 5 and cooperate with the ends of side walls of respective guiding tracks 8 which are situated in two or more consecutive sections 10 and 11 of the plate 7 in order to insure a preliminary selection and the final selection of a track 8 for the bar 5. As mentioned above, each control plate 7 has as many guiding tracks 8 as many switching positions are required for the bars 5. In the example of FIG. 2, there are provided five guiding tracks 8. The switching flaps 9 are in the form of elongated tongues displacable across one or more guiding track and in this example are pivotably supported in bearings 12. In each section 10 and 11, the switching flaps 9 are arranged in pairs whereby the two flaps 9 in section 10 are pivotable to close either the two lateral tracks 8 or selectably to open at least one of the lateral tracks and close the intermediate tracks. The pair of flaps 9 in the section 11 controls in a similar manner the three intermediate tracks. As a result, the flaps can be angularly displaced to any combination permitting the introduction of the control bolt 5 into a pre-selected guiding track 8. The pivot points of bearings 12 of the flaps 9 as illustrated in FIG. 2 can be located at the ends of respective plate sections 10 and 11 and the switching flaps are pointed in the direction of movement of the bars 5. Instead of a pivotable support for the flap 9 it is also possible to provide a support for a translatory movement of the flaps or to make the flaps sinkable in the plate 7. When the bearings 12 for the two flaps 9 are spaced apart only about the width of one track 8 such as for example at the end of the downstream section 11, so it is advantageous to make only a single bearing 14 for both switching flaps 9′ and 9″ (FIG. 3) and the latter rotate about a common axis 15.

Figure 5:
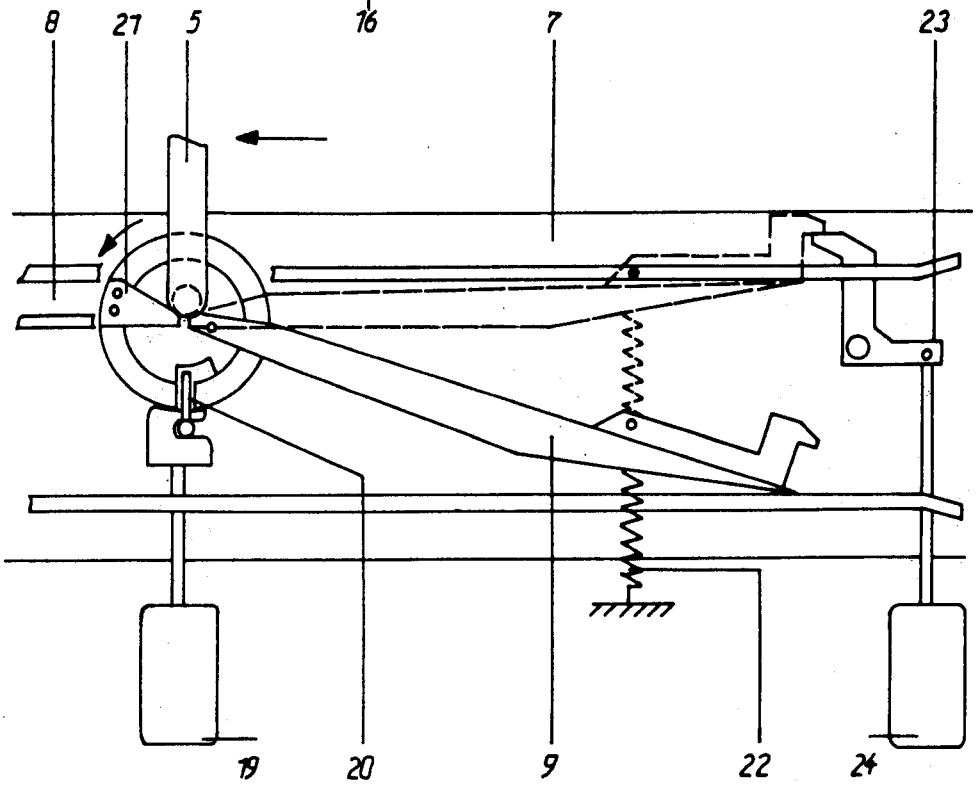
FIG. 5 is a modification of a flap adjuster.

The flaps 9 or 9′ and 9″ are actuated by a direction control member 16 or are linked to a pair of single action control members or are biased in one direction by a spring 22 and actuated by a single action control member 19 (FIG. 5). Preferably, in the starting range of engagement with the control rods 5 and at the linking points with the control elements 16, the switching flaps are reinforced by attachments 17. The control members 16 can be in the form of solenoids, stepping motors, or hydraulic or pneumatic control elements. All control elements 16 are located in a single housing 18 adjoining the superposed switching plates 7.

The operation of the automatic control device for controlling the function of the knitting machine and the design of the knit wear may be as follows: a conventional non-illustrated control unit activates first control members 16 in the upstream section 10 to activate simultaneously the corresponding flaps 9 into a position pertaining to a preliminary introduction of the control bar 5 into the selected guiding track 8. As soon as this preliminary switching action is completed, the bar 5 arrives into the section 10 and at this instant the control member 16 and the second section 11 are activated and displace the corresponding flaps 9 into the final guiding position in which it directs the advancing bar 5 in the selected track. As soon as the bar 5 leaves the section 10 the flaps in the latter are ready for a new adjustment corresponding with the desired position of the subsequent control bar 5. The preliminary and the final introduction of this subsequent bar is effected in the same manner as described above. Upon passage to the second section 11 the bar 5 is axially displaced in the preselected track and thus the control position of the bar for the subsequent needle bed pair is correctly adjusted.

By virtue of the division of a stationary switching plate 7 into two or more sections 10 and 11 and due to short switching parts of the control member 16 which can be made independently in each of the plate sections, a substantial increase of the knitting speed and of the number of knit carriages is made possible.

Instead of using control member 16, the switching flaps 9 can be displaced into a correct switching position by the force of the knit carriage itself via the control rod 5 (FIG. 5). For this purpose each flap 9 is provided at its bearing with a coupling 20 activated by a control member 19 and with a switching surface 21 connected to the bearing. The switching surface 21 when the coupling 20 is activated engages the control bolt 5 and rotates the flaps 9 in the direction of a row while displacing the flaps 9 against the force of spring 29 in a position indicated by dashed lines. In the latter position the flap is arrested by an arresting pawl activated by an additional control member 24. If it is desired to return the flap into its initial position, the additional control member 24 is energized and the pawl released the end of the flap and the spring returns the flap into abutment against a side of the track 8.

It will be understood that each of the elements described above, or two or more together, may also find a useful application in other types of constructions differing from the types described above.

While the invention has been illustrated and described as embodied in specific examples of the control device for flat bed knitting machines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A control device for flat knitting machines of the type having at least two pairs of consecutively arranged needle beds and a plurality of knit carriages circulated in one direction above the needle beds and each supporting adjustable control bars, and stationary control plates arranged between the respective pairs of needle beds to cooperate with the assigned control bars, comprising: a plurality of parallel control tracks provided on each of said control plates to guide the assigned control bars; a plurality of movable switching guides arranged on each control plate for directing said control bars into preselected tracks; and means for activating said switching guides according to the movement of said control bars.

2. A control device as defined in claim 1, wherein said control guides are arranged on consecutive sections of said control plates to provide a preliminary and a final guidance of said bars into the preselected track.

3. A control device as defined in claim 2, wherein each of said sections includes a pair of said switching guides and said activating means to simultaneously activate the guides first in the upstream section and subsequently in the downstream section.

4. The control device as defined in claim 3, wherein said switching guides are in the form of elongated tongs pivotably arranged in each section to selectively cross at least one of said tracks.

5. The control device as defined in claim 4, wherein the pair of switching guides in said downstream section are pivotable about a common pivot axis.

6. The control device as defined in claim 4, wherein the activating means includes a plurality of control members assigned to respective switching guides.

7. The control device as defined in claim 4, wherein each pair of said switching guides in respective sections is activated by a double action control member.

8. The control device as defined in claim 4, wherein said activating means for each switching guide includes a biasing spring and a single control member.

9. The control device as defined in claim 4, wherein the starting range of each switching guide is reinforced by an attachment.

10. The control device as defined in claim 6, wherein said control member is a stepping motor.

11. The control device as defined in claim 6, wherein said control member is a solenoid.

12. The control device as defined in claim 6, wherein said control member is a pneumatic control element.

13. The control device as defined in claim 6, wherein said control member is a hydraulic control element.

14. The control device as defined in claim 4, wherein said activating means for each switching guide includes a spring for biasing the guide into a rest position and a controllable arresting member for arresting the guide in an opposite position, a switching surface connected to the switching guide for engaging the advancing control bar in order to displace the switching guide into said opposite position and a controllable coupling for selectively arresting said switching guide in said rest position.

* * * * *